US006189681B1

(12) United States Patent
England

(10) Patent No.: US 6,189,681 B1
(45) Date of Patent: Feb. 20, 2001

(54) AUGER CLEANERS

(76) Inventor: Melvin Gerard England, 14 Scotts Avenue, Sunbury upon Thames, Middlesex TW16 7HZ (GB)

( * ) Notice: Under 35 U.S.C. 154(b), the term of this patent shall be extended for 0 days.

(21) Appl. No.: 09/367,937

(22) PCT Filed: Dec. 23, 1998

(86) PCT No.: PCT/GB98/03891

§ 371 Date: Nov. 24, 1999

§ 102(e) Date: Nov. 24, 1999

(87) PCT Pub. No.: WO99/34086

PCT Pub. Date: Jul. 8, 1999

(30) Foreign Application Priority Data

Dec. 24, 1997 (GB) ..... 9727273

(51) Int. Cl.[7] ..... B65G 45/18
(52) U.S. Cl. ..... 198/496
(58) Field of Search ..... 198/496, 498

(56) References Cited

U.S. PATENT DOCUMENTS

| | | | | |
|---|---|---|---|---|
| 165,228 | * | 7/1875 | Gent | 198/496 X |
| 1,602,375 | | 10/1926 | Gibson . | |
| 3,540,572 | * | 11/1970 | McCall | 198/496 |
| 3,782,535 | * | 1/1974 | Yousch | 198/498 |
| 4,650,012 | | 3/1987 | Bollinger et al. . | |
| 5,242,027 | | 9/1993 | Blum . | |

FOREIGN PATENT DOCUMENTS

| | | | | |
|---|---|---|---|---|
| R 15573 | * | 10/1956 | (DE) | 198/496 |
| 0428904 | | 5/1991 | (EP) . | |
| 2594481 | | 8/1987 | (FR) . | |
| 2158130 | | 11/1985 | (GB) . | |
| 2265922 | | 10/1993 | (GB) . | |
| 64-11629 | * | 1/1989 | (JP) | 198/498 |
| S-147721 | * | 6/1993 | (JP) | 198/498 |
| 1253902 | * | 2/1986 | (SU) | 198/498 |

* cited by examiner

*Primary Examiner*—James R. Bidwell
(74) *Attorney, Agent, or Firm*—Browdy and Neimark

(57) ABSTRACT

A tool for removing debris from a helical blade of an auger or other screw-conveyor, the tool comprising a central shaft about which is helically arranged a plurality of radially projecting elements. In use, the tool is rotated as the auger is withdrawn from the ground, and the radially projecting elements pass between adjacent flights so as to remove locked-in soil.

10 Claims, 3 Drawing Sheets

AUGER CLEANERS

CROSS REFERENCE TO RELATED APPLICATION

The present application is the national stage under 35 U.S.C. 371 of PCT/GB98/03891, filed Dec. 23, 1998.

BACKGROUND OF THE INVENTION

1. Technical Field of the Invention

The present invention relates to tools for cleaning an auger, in particular but not exclusively a continuous flight auger, as it is being withdrawn or after it has been withdrawn from the ground.

2. Prior Art

Augers are commonly used in civil engineering applications such as piling, a particular example of this being Continuous Flight Auger (CFA) piling. A continuous flight auger comprises a generally cylindrical elongate body provided with a generally helical blade. Each 360° turn of the auger defines a flight of the blade, i.e. a flight is the space between adjacent, longitudinally-spaced sections of the blade. In use, the auger is rotated into the ground to a predetermined depth at which the downward advance of the auger is halted. The auger may then be withdrawn without further rotation, thereby shearing a "plug" of soil directly from the ground so as to form a bore hole, or the auger may be rotated before withdrawal so as to shear the soil on the flights from the soil which will eventually form the wall of the resultant bore hole. During withdrawal, concrete or grout may be pumped through the auger or down a feed pipe under positive pressure so as to form a cast-in-situ pile.

Upon withdrawal, the flights of the auger are generally loaded with soil, and there is a danger that some of this soil will become locked between adjacent flights instead of falling out cleanly as the auger emerges above ground level. As the auger continues to be withdrawn, the flights with the locked-in soil will be raised to levels some distance (typically up to 20 m) above the ground, and there is a significant danger that the locked-in soil may loosen and fall onto operating personnel on the ground, possibly causing serious injury. This is becoming more of a problem with modern CFA piling techniques, since these often require a tight entry into the ground which results in soil being packed onto the flights in a particularly dense and compact manner.

Traditionally, augers have been cleaned by hand, for example by using a scraping implement and sometimes water jets. This, however, is labour intensive and can be dangerous.

It is known from GB 2 235 480 A (amongst others) to scrape soil off the flights of a rotating auger by deploying a toothed wheel next to the auger in the manner of a worm drive. As the auger rotates, so does the wheel, the teeth of the wheel engaging between the flights and thereby scraping off locked-in soil. This technique is not particularly effective, since only soil locked in a single flight is attacked at any one time. Furthermore, if the auger is being withdrawn rather than merely being rotated out of the ground, then the toothed wheel will tend to miss sections of the auger flights.

OBJECT AND SUMMARY OF THE INVENTION

According to the present invention, there is provided a tool for removing debris from the flights of an auger or other screw-conveyor, the tool comprising a central shaft about which is helically arranged a plurality of radially projecting elements.

In use, the tool is mounted adjacent to an auger with the central shaft being substantially parallel to the auger stem. Advantageously, the tool is mounted in such a way that it can be moved near to and away from the auger in such a way that the projecting elements may be gradually introduced to the auger flights. Cleaning the auger in this manner is assisted by way of soil being packed more loosely between the flights at the top of the auger than between those at the bottom. The radially projecting elements are arranged in a helix wherein the elements are angularly and axially displaced from each other on a central axis, in a manner in which the helix has substantially the same pitch as that of the auger blade. As the auger is withdrawn from the ground, the tool is brought up to the auger and rotated so that the projecting elements engage with the auger flights. The rate and direction of rotation is dependent on the rate of withdrawal of the auger and whether or not the auger is also being rotated. In general, where the projecting elements are disposed in a helix having the opposite sense to that of the auger blade, then the tool must be rotated in the opposite direction to the auger so as to counter flight movement. Alternatively, the projecting elements may be disposed in a helix having the same sense as that of the auger blade, in which case the tool is rotated in the same direction as the auger. The former arrangement may be advantageous in that the angle of attack of the projecting elements on the flights of the auger is increased, and any locked-in soil will tend to be pushed downwards.

It is also possible to clean the auger without continuous rotation upon extraction. The auger may, for example, be repeatedly turned forwards by half a turn and then backwards by half a turn, with the tool rotating accordingly.

A particular advantage of the present invention is that it can be used in applications where an auger is rotated relatively slowly during withdrawal. This is because the projecting elements simultaneously penetrate adjacent flights of the auger. Furthermore, since rotation of the tool allows continuous parallel movement between the tool and the auger, the tool does not need to be separated from and repositioned on the auger as it is withdrawn. This helps to ensure that no sections along the length of the auger are missed. Advantageously, two, three or more tools may be disposed substantially equiangularly about the auger so as to attack soil on the auger flights from a number of directions simultaneously. Such an arrangement, particularly with three tools, also means that any lateral forces which may tend to push a single tool and the auger away from each other may be balanced out.

The tool may be rotated by way of a mechanical linkage which couples the tool to the auger drive means. Such a linkage, which may take the form of a bushing or other driving arrangement, automatically synchronises the rotations of the tool and the auger so as to prevent relative fouling.

Alternatively, the tool may be rotated by way of an independent electric or hydraulic motor. In order to ensure synchronisation with the rotation of the auger, sensors are provided which detect the proximity of the auger flights to the tool. When a sensor detects that the tool and the auger are not in synchronisation, i.e. the projecting elements are not disposed substantially in the middle of each flight, appropriate rotation of the tool is commanded so as to bring the projecting elements back to the mid-point of each flight. On-board instrumentation and computer means may be provided so as to allow complete control of the tool. For example, given the angle of rotation of the auger, the depth change and the pitch of the auger blade, it is possible to calculate and apply the correct rate of rotation to the tool so as to ensure synchronisation with the auger.

The radially projecting elements may take the form of blades, cutting tools, digging tools, brushes and any combination thereof. It is generally preferred to include at least one blade or cutting tool, since soil removal is facilitated by cutting a groove into the locked-in soil so as to allow the same to swell and hence to fall away from the auger. The radial extension of at least some of the projecting elements should be at least as great as the radius of the largest auger with which the tool is to be used. This is to ensure that the flights are cleaned thoroughly. In some embodiments, the envelope defining the radial extension of the projecting elements may be selected to start from the diameter of the central shaft at the lower end of the tool and gradually to increase along the length of the tool until full penetration of the auger flights is achieved. A further feature is that different projecting elements may be arranged along the length of the tool so as to facilitate the removal of different conditions of soil, for example loosely- or densely-packed. For example, brushes can be arranged at the top of the tool so as to complete the auger cleaning operation. The projecting elements need not be permanently attached to the central shaft of the tool, but may be readily interchanged so as to allow the tool to be tailored to specific applications.

In embodiments where the tool is mounted so that it may be moved near to and away from the auger, generally by way of a pivot, it is possible to swing the tool out of the way of any drive head which may be mounted at the top of the auger, thereby allowing the auger to be rotated into the ground to a greater depth than would otherwise, be possible. One way in which this may be achieved is to drive the tool from its lower end.

BRIEF DESCRIPTION OF THE INVENTION

For a better understanding of the present invention, and to show how it may be carried into effect, reference will now be made, by way of example, to the following drawings, in which.

DETAILED DESCRIPTIONS OF THE PREFERRED EMBODIMENTS OF THE INVENTION

Figure 1:
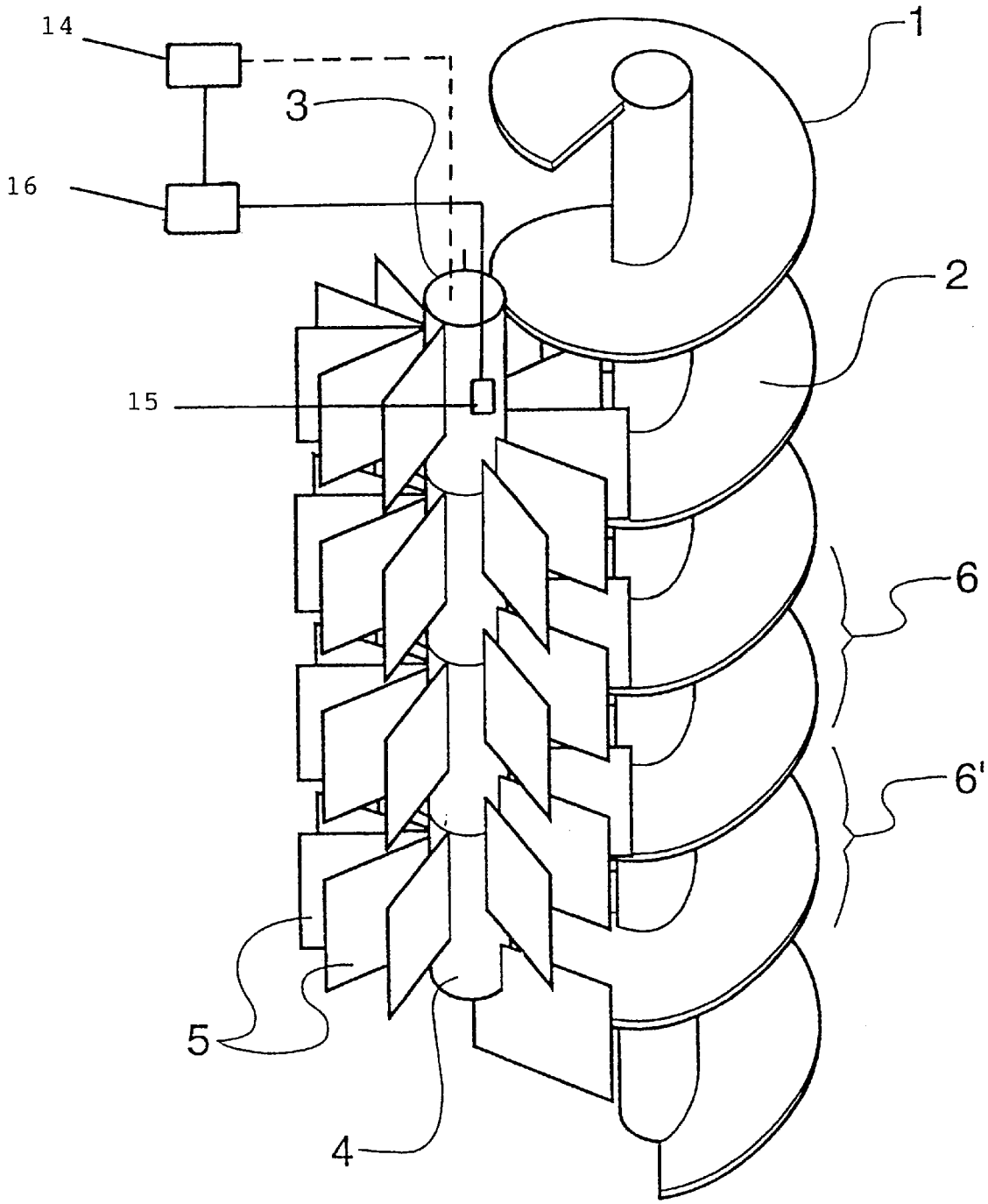
FIG. 1 shows an auger cleaning tool engaged with an auger.

FIG. 1 shows an auger 1 having a blade 2. A tool 3, comprising a central shaft 4 on which are removably mounted a number of flat blades 5 in a helical formation wherein the blades 5 are angularly and axially displaced from each other on central axis 4 so that each blade 5, engages with the blade 2 of the auger 1. The pitch of the blades 5 is substantially the same as the pitch of the auger blade 2, and the sense of the helical arrangement of the blades 5 is opposite to that of the blade 2. In the embodiment shown, the tool 3 has a length of around 1 to 2 m, and the auger 1 has a length of up to 20 m. In use, as the auger 1 is withdrawn from the ground, the tool 3 is rotated so as to counter the movement of the blade 2 of the auger 1. Rotation of the tool 3 is synchronised with rotation of the auger 1 so that the blades 5 penetrate adjacent flights 6, 6' without fouling the blade 2 itself. In this way, any soil (not shown) locked into the flights 6, 6' of the auger 1 is effectively removed.

As shown in FIG. 1, the tool is rotated by drive means comprising an electric on hydraulic motor 14. In order to ensure synchronization with the rotation of the auger, sensors 15 are provided which detect the proximity of the auger flights to the tool. When a sensor 15 detects that the tool and the auger are not in synchronization, appropriate rotation of the tool is commanded by feedback control 16 to bring the projecting elements back to the midpoint of each flight without fouling the blade.

Figure 2:
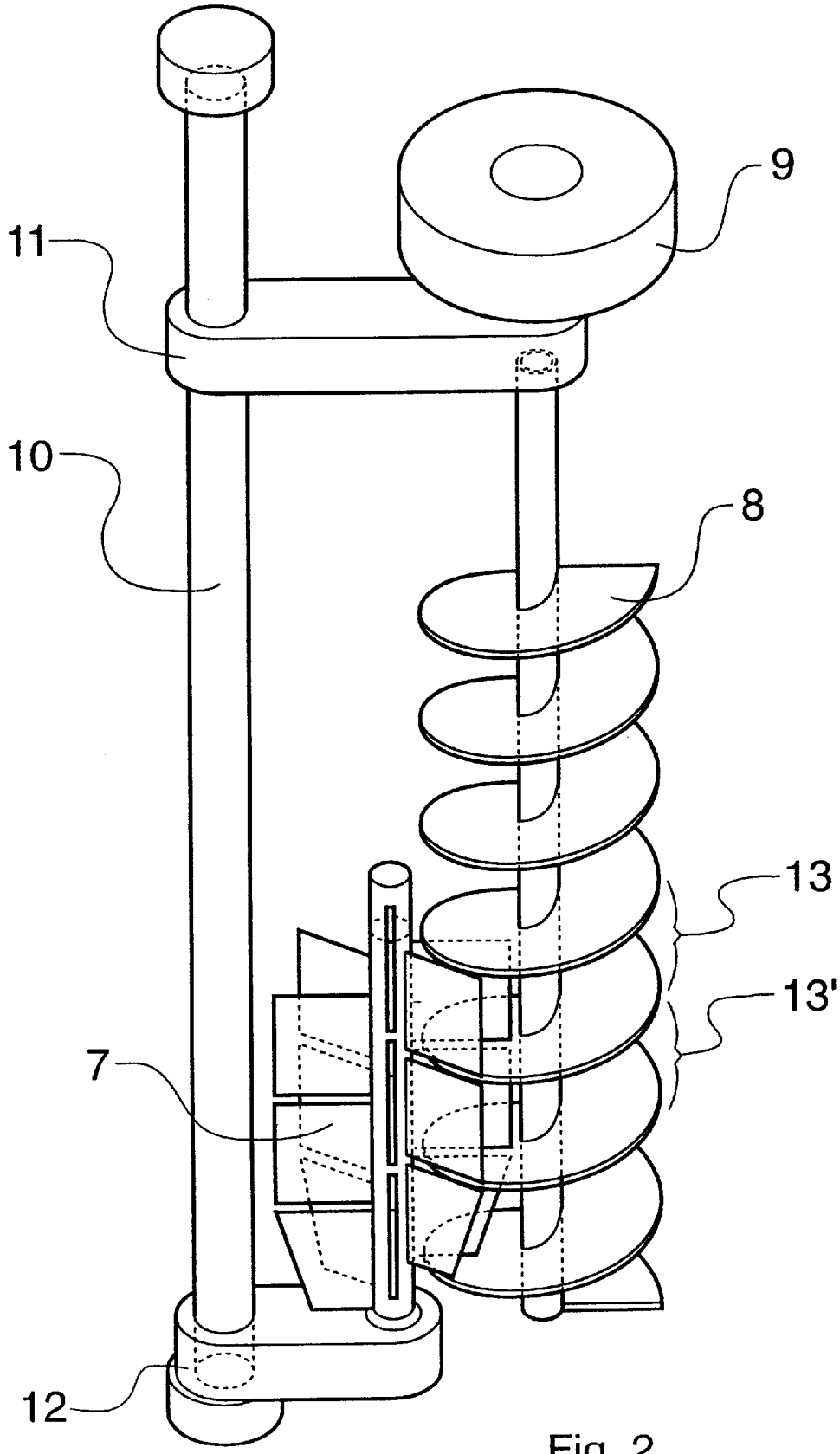
FIG. 2 shows a pivotally-mounted auger cleaning tool engaged with an auger.
Figure 3:
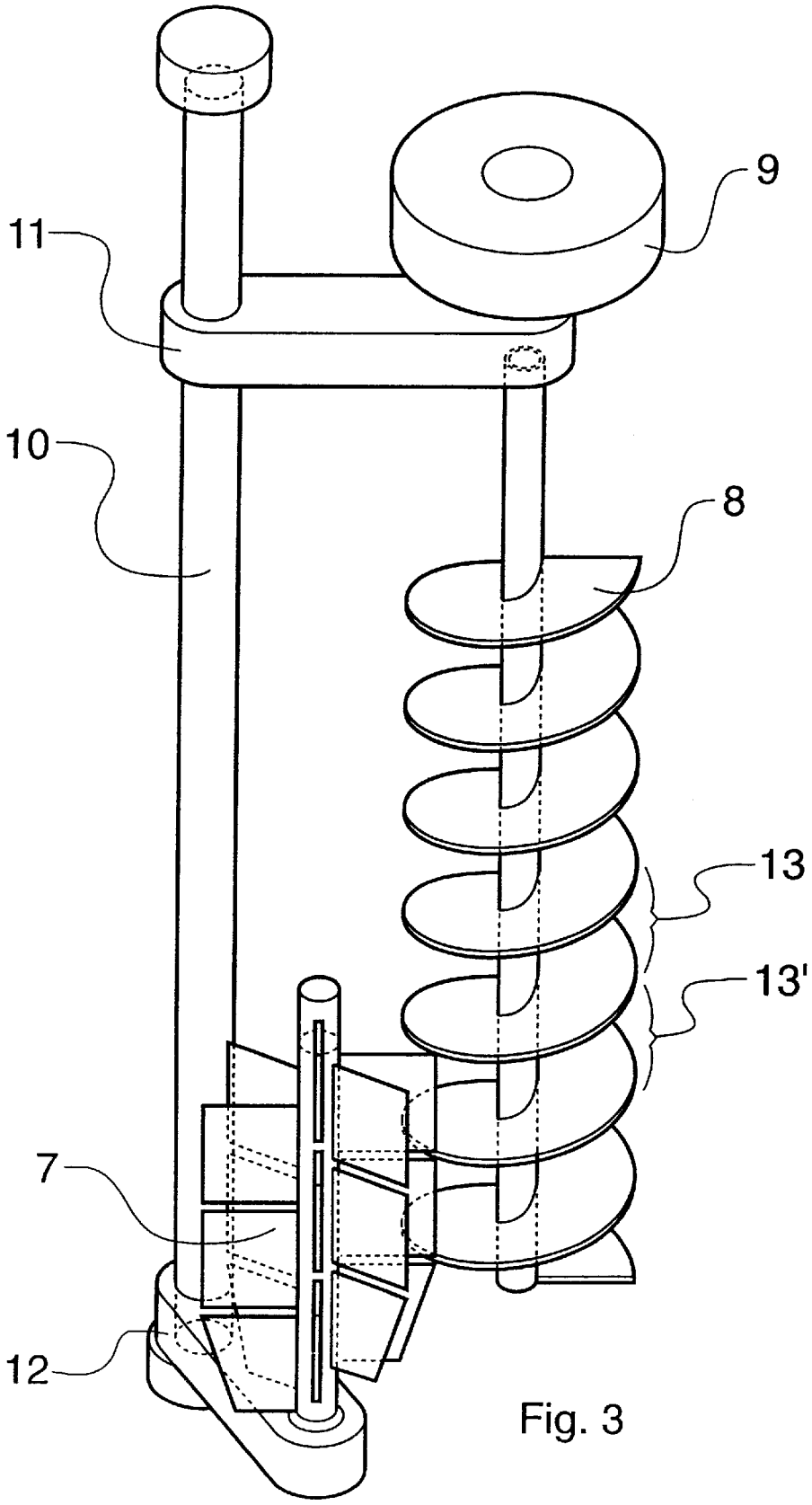
FIG. 3 shows the auger cleaning tool of FIG. 2 moved to a position away from the auger.

An alternative arrangement is shown in FIGS. 2 and 3, where an auger cleaning tool 7 is pivotably mounted next to an auger 8. The auger 8 is rotated by way of a drive head 9 mounted at the top of the auger 8. The drive head also serves to rotate the tool 7 in the appropriate direction by way of a shaft 10 and mechanical linkages 11 and 12. As shown best in FIG. 3, the tool 7 may be swung away from the auger 8 so that it no longer engages with the flights 13, 13' of the auger, thereby allowing the drive head 9 to pass by most of the body of the tool 7 and thereby enabling the auger to penetrate the ground to a deeper level than would otherwise be the case.

What is claimed is:

1. A tool for removing debris from flights of a blade of an auger or other screw conveyor, the tool comprising a central shaft about which is helically arranged a plurality of radially projecting elements, wherein said projecting elements are disposed about said central shaft such that there exists an angular displacement and an axial displacement between each of the projecting elements.

2. A tool as claimed in claim 1, wherein the radially projecting elements are selected from the group consisting of blades, cutting tools, and digging tools.

3. A tool as claimed in claim 1, wherein the radially projecting elements comprise brushes.

4. A tool as claimed in claim 1, 2, wherein the radially projecting elements are detachably mounted on the central shaft.

5. A tool as claimed in claim 1, wherein the radial extension of the radially projecting elements increases along at least a portion of the length of the tool from bottom to top.

6. A tool as claimed in claim 1, wherein the tool, in use, is rotatably mounted adjacent the auger such that at least some of the radially projecting elements penetrate at least some of the flights of the auger.

7. A tool as claimed in claim 6, wherein the tool, in use, is mounted so that it may be moved near to and away from the auger in such a way that the radially projecting elements may be gradually introduced into the flights of the auger.

8. A tool as claimed in claim 7, wherein the tool may be moved away from the auger so as to allow the auger to bypass at least part of the tool during insertion and extraction.

9. A tool as claimed in claim 6, wherein the tool is mechanically coupled to drive means adapted to rotate the auger, such that the tool is rotated in synchronism with the auger.

10. A tool as claimed in claim 6, wherein the tool is provided with separate rotational drive means and with sensors which detect the proximity of the radially projecting elements to the blade of the auger, a feedback control mechanism being provided between the drive means and the sensors which controls the rotation of the tool so as to tend to pass the projecting elements between adjacent flights without fouling the blade.

* * * * *